US009424784B2

(12) United States Patent
Guo et al.

(10) Patent No.: US 9,424,784 B2
(45) Date of Patent: Aug. 23, 2016

(54) ARRAY SUBSTRATE AND DISPLAY DEVICE

(71) Applicants: BOE Technology Group Co., Ltd., Beijing (CN); Beijing BOE Display Technology Co., Ltd., Beijing (CN)

(72) Inventors: Rui Guo, Beijing (CN); Zongze He, Beijing (CN); Lei Liu, Beijing (CN); Weihao Hu, Beijing (CN); Yoon Dae Keun, Beijing (CN)

(73) Assignees: BOE Technology Group Co., Ltd., Beijing (CN); Beijing BOE Display Technology Co., Ltd., Beijing (CN)

( * ) Notice: Subject to any disclaimer, the term of this patent is extended or adjusted under 35 U.S.C. 154(b) by 0 days.

(21) Appl. No.: 14/480,883

(22) Filed: Sep. 9, 2014

(65) Prior Publication Data

US 2015/0379942 A1 Dec. 31, 2015

(30) Foreign Application Priority Data

Jun. 25, 2014 (CN) ..... 2014 1 0290281

(51) Int. Cl.

*G09G 5/00* (2006.01)
*G09G 3/34* (2006.01)
*G09G 3/36* (2006.01)

(52) U.S. Cl.

CPC ..... *G09G 3/3426* (2013.01); *G09G 3/3611* (2013.01); *G09G 2320/0233* (2013.01); *G09G 2320/0257* (2013.01); *G09G 2320/0646* (2013.01)

(58) Field of Classification Search

CPC ..... G09G 5/00; G09G 3/3611; G06K 9/40
USPC ..... 345/204; 382/266
See application file for complete search history.

(56) References Cited

U.S. PATENT DOCUMENTS

2004/0263495 A1* 12/2004 Sugino ..... G09G 3/3611 345/204
2010/0303378 A1* 12/2010 Chang ..... G06T 5/002 382/266

* cited by examiner

*Primary Examiner* — Nicholas Lee
*Assistant Examiner* — Abdul-Samad A Adediran
(74) *Attorney, Agent, or Firm* — Westman, Champlin & Koehler, P.A.

(57) ABSTRACT

The present invention discloses a local backlight brightness adjustment method for a direct backlight in a display device, the method comprising the steps of: step 1: performing edge detection on an input image to determine whether a sensitive zone exists, the sensitive zone being a portion in the input image in which a gray level difference between adjacent pixels is greater than a predetermined threshold; and Step 2: if a sensitive zone exists, performing a backlight brightness adjustment with respect to a backlight region corresponding to the sensitive zone and a remaining backlight region other than the backlight region corresponding to the sensitive zone, respectively. According to the above-mentioned technical solution, since the backlight brightness adjustment are performed with respect to the backlight region corresponding to the sensitive zone and the remaining backlight region other than the backlight region corresponding to the sensitive zone, respectively, thus, when there is gray level abruptly-varying portion in the image, the display performance of the displayer can still be ensured.

10 Claims, 3 Drawing Sheets

ARRAY SUBSTRATE AND DISPLAY DEVICE

CROSS-REFERENCE TO RELATED APPLICATION

This application claims the benefit of Chinese Patent Application No. 201410290281.9 filed on Jun. 25, 2014 in the State Intellectual Property Office of China, the whole disclosure of which is incorporated herein by reference.

BACKGROUND OF THE INVENTION

1. Field of the Invention

The present invention relates to field of display technology, more particularly, relates to a method for adjusting the local backlight brightness of direct backlight in a display device.

2. Description of the Related Art

Recently, the liquid crystal display screen (LCD) is widely used from hand-held player, cell phone with small screen to LCD TV and computer display with large screen, and thus plays more and more important role in daily life of human being. Along with that, the energy-consumption thereof increasingly arouses concern. Since the LCD itself cannot emit light, it needs a powerful light source to provide backlight. However, this kind of light sources, such as a cold cathode fluorescent lighting (CCFL) or a light-emitting diode (LED) widely used in a LCD TV, consume large electricity energy. For example, when a typical 3.5 inch hand-held player plays a video, the total power consumption is about 500 mW, in which the power consumption of LCD screen is about 300 Mw. That's to say, the power consumption of LCD screen is about 60% or more of that of the whole player. Considering a whole LCD sub-system, including a control circuit and a frame buffer, the percentage of power consumption of LCD screen in the total power consumption of the system is much higher. Hence, it is quite meaningful to reduce the power consumption of the LCD to save energy and benefit the green society. Since the backlight source is a predominant energy consumer of LCT screen, people has endeavored to reduce the power consumption of backlight source.

In prior art, the method for reducing the power consumption of the backlight source comprises improving a drive-circuit of the backlight source, improving a luminous efficiency of LED, developing a new kind of LED, and adjusting the backlight according to the brightness of environment, etc. However, the local backlight adjusting method is a method easy to implement and having a significant effect. Especially, the local backlight adjusting method for direct backlight has effects of significantly reducing power-consumption of LCD screen, improving the contrast value and gray level value of a display image and reducing ghost, etc.

Many local backlight adjusting methods have been proposed, such as a local backlight adjusting and compensating method for direct backlight. The flow chart thereof is shown as FIG. 3. According to the method, the whole backlight region facing the display panel is divided into a plurality of backlight sub-regions (generally, the backlight region has already been divided into a number of sub-regions when designing the direct backlight source). The method comprises analyzing the gray level of a frame of input image signal (input image), and obtaining the average gray level or weighted gray level of the pixels corresponding to each backlight sub-region; since the backlight intensity of each backlight sub-region is independent from each other, dynamic adjusting may be performed with respect to backlight in the respective backlight sub-regions according to different gray levels of image signals and the gray level of the image to be displayed; the object of backlight adjusting is to adjust the brightness of each backlight sub-region. While the backlight brightness is adjusted, the backlight adjusting brightness information or gray level information of each backlight sub-region needs to be output to a backlight brightness simulating unit to perform a brightness simulation. According to the result of brightness simulation, an image is compensated and eventually displayed after being compensated so that a human being can perceive a consistent brightness.

The above-mentioned method can ensure the display quality of most images as well as reducing power consumption. The method, however, may have a problem when there is a gray level abruptly-varying portion in the image to be displayed. Usually, the gray level abruptly-varying portion can not be normally displayed. Examples of the image including a gray level abruptly-varying portion include a night image as shown in FIG. 1A and an annular eclipse image as shown in FIG. 2A. For this kind of image, since the gray level of this kind of image is quite low as a whole, the adjusted backlight brightness is quite low, and thus the image needs to be compensated considerably, so that the brightness perceived by a human being is not changed quite a lot. However, since the gray level of this kind of image is quite low as a whole, even if the pixel value of the image is compensated up to the highest gray level 255, the dramatic reduction of brightness caused by local backlight adjusting cannot be fully compensated. Meanwhile, a color error may occurred due to overcompensation and cause a clipping phenomenon as shown in FIG. 1*b*. On the other hand, if the gray level abruptly-varying portion in an input image crossing different backlight sub-regions, as shown in FIG. 2A, since the average gray levels of the pixels in different backlight sub-regions are different, the brightness of different backlight sub-region s are inconsistent, then the phenomenon of edge breakage as shown in FIG. 2B may occur, which will affect the eventual display performance.

SUMMARY OF THE INVENTION

The object of the present invention is to solve at least one problem as mentioned above in prior art.

The present invention provides a method for adjusting local backlight brightness of a direct backlight in a display device, the method comprising the following steps:

step 1: performing edge detection on an input image to determine whether a sensitive zone exists, the sensitive zone being a portion in the input image in which a gray level difference between adjacent pixels is greater than a predetermined threshold; and Step 2: if a sensitive zone exists, performing a backlight brightness adjustment with respect to a backlight region corresponding to the sensitive zone and a remaining backlight region other than the backlight region corresponding to the sensitive zone, respectively.

According to the above method, since the backlight brightness adjustment are performed with respect to the backlight region corresponding to the sensitive zone and the remaining backlight region other than the backlight region corresponding to the sensitive zone, respectively, thus, when there is gray level abruptly-varying portion in a image, the display performance of the display can still be ensured.

DETAILED DESCRIPTION OF PREFERRED EMBODIMENTS OF THE INVENTION

For the purpose of illustrating the object, technical solution and advantages of the present invention more clearly, the present invention will be described hereinafter in details with reference to the attached drawings and in combination with the detailed exemplary embodiments.

As a portion of a local backlight brightness adjustment and compensation method, embodiments of the present invention provides a local backlight brightness adjustment method, comprising the following steps:

step 1: performing edge detection on an input image to determine whether a sensitive zone exists, the sensitive zone being a portion in the input image in which a gray level difference between adjacent pixels is greater than a predetermined threshold; and Step 2: if a sensitive zone exists, performing a backlight brightness adjustment with respect to a backlight region corresponding to the sensitive zone and a remaining backlight region other than the backlight region corresponding to the sensitive zone, respectively.

According to an embodiment, in step 2, performing the backlight brightness adjustment with respect to the backlight region corresponding to the sensitive zone comprises:

performing clipping pre-process on an average gray level of pixels in the backlight region corresponding to the sensitive zone, so as to increase or decrease the average gray level of the pixels in the backlight region corresponding to the sensitive zone.

Specifically, if the average gray level of the pixels in the backlight region corresponding to the sensitive zone is lower than an average gray level of pixels of a backlight region adjacent to the backlight region corresponding to the sensitive zone, the clipping pre-process comprises increasing the average gray level of the pixels in the backlight region corresponding to the sensitive zone; if the average gray level of the pixels in the backlight region corresponding to the sensitive zone is higher than the average gray level of the pixels in the backlight region adjacent to the backlight region corresponding to the sensitive zone, the clipping pre-process comprises decreasing the average gray level of the pixels in the backlight region corresponding to the sensitive zone.

Figure 1A:
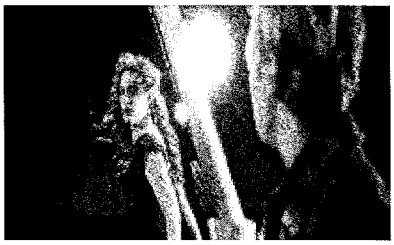
FIG. 1A is an input image obtained according to an input signal as an example.
Figure 1B:
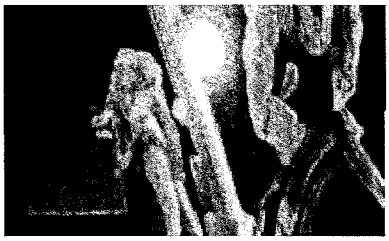
FIG. 1B is a display image, which is corresponding to the image of FIG. 1A and obtained by the local backlight brightness adjustment method according to the prior art.

According to the embodiment, it can prevent the clipping phenomenon due to overcompensation as shown in FIG. 1B and thus avoid color error by performing clipping pre-process on the average gray level of the pixels in the backlight region corresponding to the sensitive zone.

According to another embodiment, in step 2, performing the backlight brightness adjustment with respect to the backlight region corresponding to the sensitive zone comprises:

Step 21: determining a smallest backlight region covering the sensitive zone, the smallest backlight region at least including a plurality of backlight sub-regions corresponding to the sensitive zone;

Step 22: calculating a weighted average of the gray level values of the pixels in the smallest backlight region, to obtain a region average gray level of the pixels corresponding to the smallest backlight region; and Step 23: performing the backlight brightness adjustment uniformly with respect to the smallest backlight region based on the calculated region average gray level.

Further, performing the backlight brightness adjustment with respect to the remaining backlight region comprises:

calculating a weighted average of the gray level values of pixels in each backlight sub-region included in the remaining backlight region, respectively, to obtain an average gray level of each backlight sub-region, respectively;

performing the backlight brightness adjustment with respect to each backlight sub-region based on the average gray level of the pixels in each backlight sub-region, respectively.

Figure 2A:
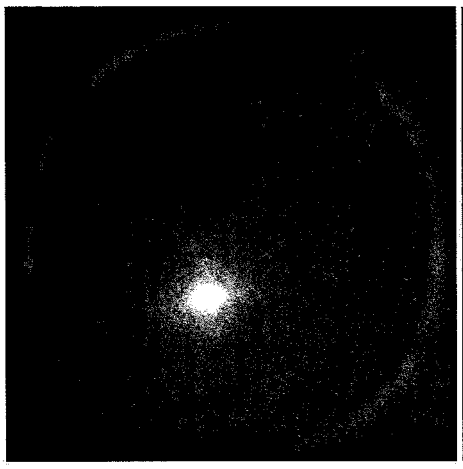
FIG. 2A is another input image as an example.
Figure 2B:
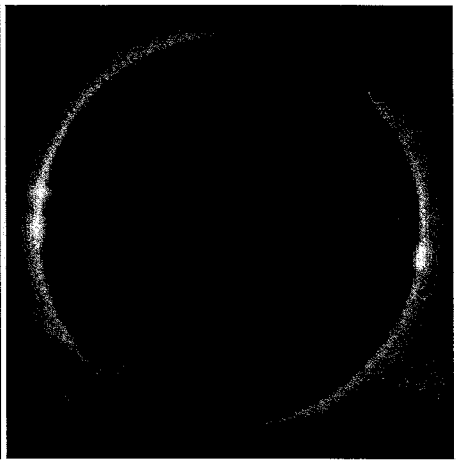
FIG. 2B is a display image, which is corresponding to the image of FIG. 2A and obtained by the local backlight brightness adjustment method according to the prior art.
Figure 3:
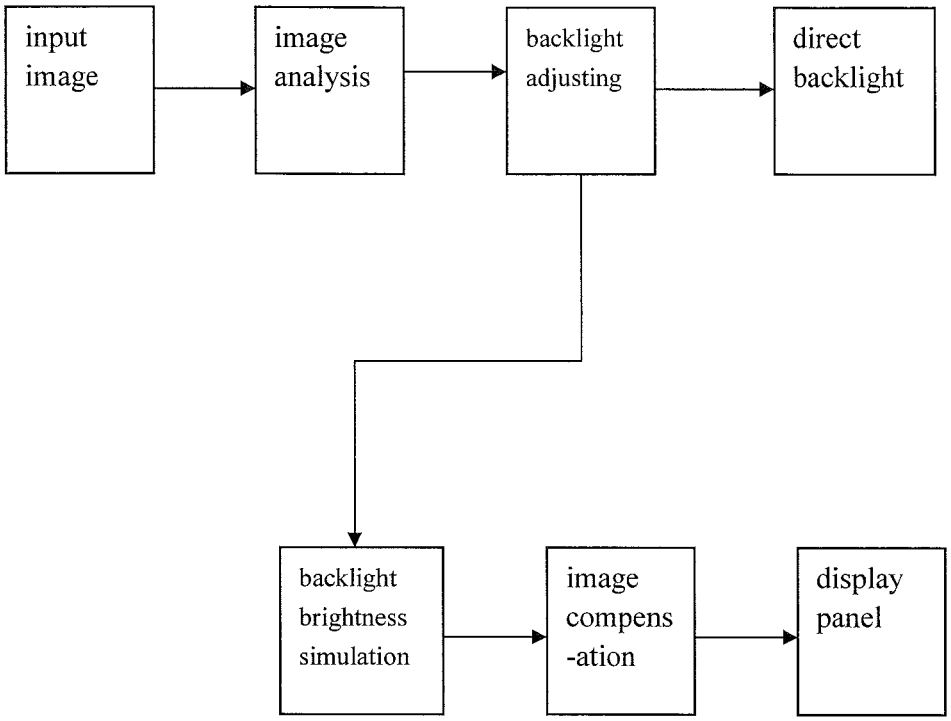
FIG. 3 is a flow chart of the local backlight brightness adjustment and compensating method for a direct backlight in a display device according to the prior art.

According to this embodiment, since the backlight brightness adjustment with respect to the backlight region corresponding to the sensitive zone is performed uniformly, the adjusting coefficient of each backlight sub-region in the backlight region corresponding to the sensitive zone can be kept consistent, so as to avoid the phenomenon of edge breakage of the image as shown in FIG. 2B due to inconsistent adjusting coefficients in different backlight sub-regions.

According to an embodiment, in step 2, performing the backlight brightness adjustment with respect to the backlight region corresponding to the sensitive zone comprises:

Step 21: determining a smallest backlight region covering the sensitive zone, the smallest backlight region at least including a plurality of backlight sub-regions corresponding to the sensitive zone;

Step 22: calculating a weighted average of the gray level values of pixels in the determined smallest backlight region, as obtain a region average gray level of the pixels corresponding to the smallest backlight region;

Step 23': performing a clipping pre-process on the region average gray level, and performing the backlight brightness adjustment uniformly with respect to the smallest backlight region based on the region average gray level obtained after the clipping pre-process.

Further, performing the backlight brightness adjustment with respect to the remaining backlight region comprises:

calculating a weighted average of gray level values of pixels in each backlight sub-region included in the remaining backlight region, as an average gray level of each backlight sub-region, respectively;

performing the backlight brightness adjustment with respect to each backlight sub-region, based on the average gray level of the pixels in each backlight sub-region, respectively.

In step 23', the clipping pre-process may comprising increasing or decreasing the region average gray level.

Specifically, if the region average gray level of the smallest backlight region is lower than an average gray level of pixels in a region adjacent to the smallest backlight region, the clipping pre-process comprises increasing the region average gray level; if the region average gray level of the smallest backlight region is higher than an average gray level of pixels in a region adjacent to the smallest backlight region, the clipping pre-process compressing decreasing the region average gray level.

According to this embodiment, the clipping phenomenon due to excessive compensation as well as the phenomenon of edge breakage of the image caused by inconsistent adjusting coefficients in different backlight sub-regions can both be alleviated, so that the details of original image can be preserved to the full extent and the excessive compensation and loss of image details can be avoided, and in turn a good image quality can be obtained.

In the description of embodiments of the present invention, the input image refers to an image transformed directly from the image signal input to a display device. In other words, the input image is the image without subjecting to backlight adjusting and compensation. The backlight region refers to the region covered by a backlight, and for a direct backlight source, the whole backlight region is substantially opposite to the display panel. The backlight sub-region refers to a backlight region, which is adjustable independently and is divided in advance according to the positions of the backlight sources, for example.

Figure 4:
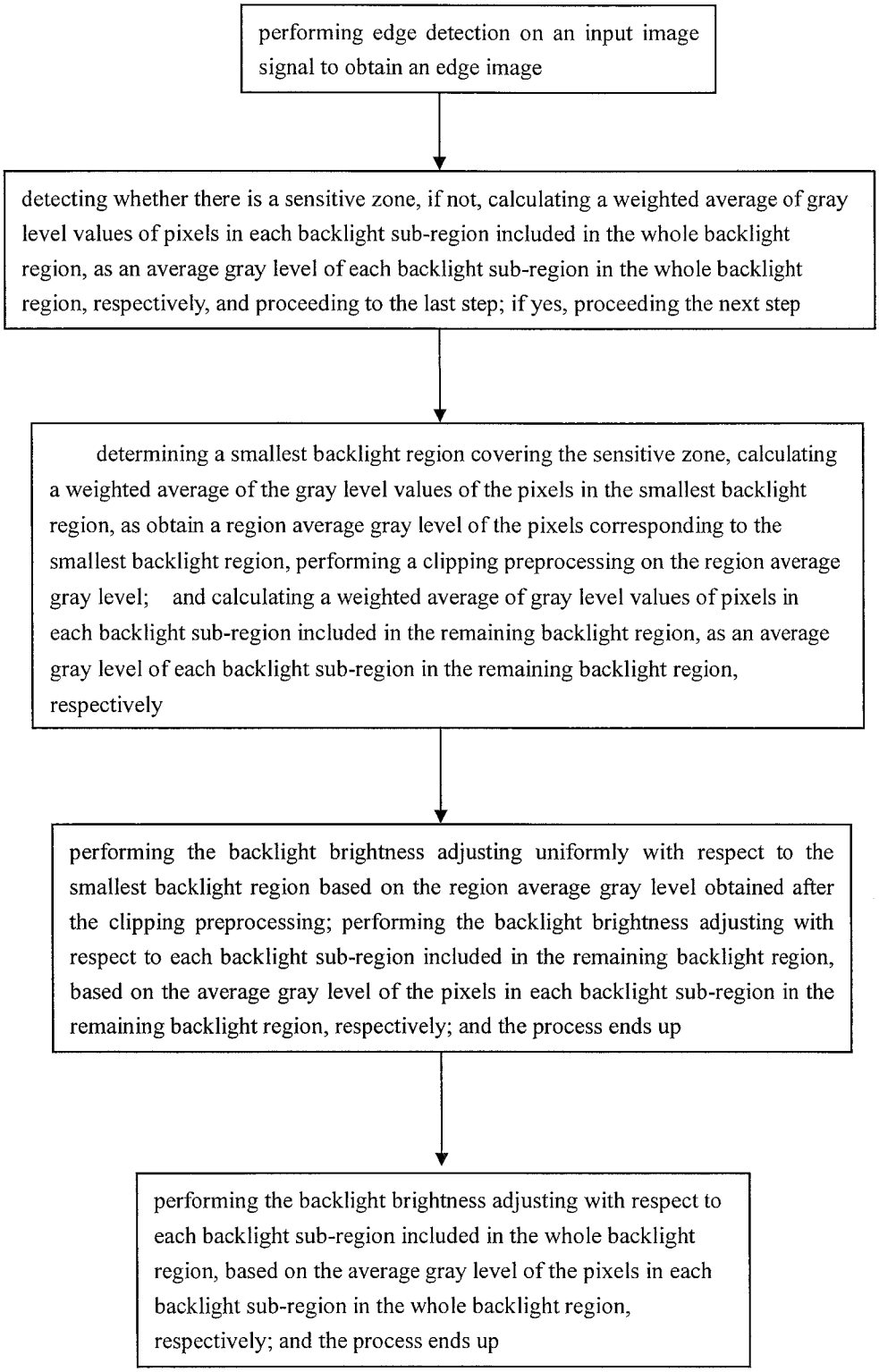
FIG. 4 is a flow chart of the local backlight brightness adjustment method for a direct backlight in a display device according to an exemplary embodiment of the present invention.

The local backlight brightness adjustment method for a direct backlight in a display device according to an exemplary embodiment of the present invention will be described in detail with reference to the flow chart shown in FIG. 4. Note that FIG. 4 is only an example according to the concept of the present invention. The concept of the present invention may be accomplished by other embodiments disclosed by the description and other embodiments conceived by a person skilled in this art based on the disclosed embodiments, and the present invention is intended to include all these embodiments.

As shown in FIG. 4, the local backlight brightness adjustment method for a direct backlight in a display device according to an exemplary embodiment of the present invention comprises the following steps:

Step 1, performing edge detection on an input image, so as to obtain a corresponding edge image;

A person skilled in this art should understand that the edge of an image has direction attribute and magnitude attribute, wherein, the variation of gray level of the pixels along the edge direction is smooth, however, the variation of gray level of the pixels along the direction perpendicular to the edge direction is quite abrupt. Hence, the variation of gray levels of the pixels of the edge may be calculated by differential operator. For instance, the edge may be detected by first-order derivative or second-order derivative. The maximum value calculated by first-order derivative corresponds to the position of an edge pixel, and a zero-crossing point calculated by the second-order derivative corresponds to the position of an edge pixel. In actual, a similar analysis can be carried out on any edge in the image in any direction.

Edge detection is a common method in pattern recognition and image process, in brief, the gray-scale image transformed from the colorful image will be processed with first-order or second-order difference calculation using the detection operator and the edge will be positioned according to the boundary of threshold set by the operator.

Specifically, the edge detection comprises the following steps:

Step 11, obtaining a gray-scale image based on an input image signal;

A gray-scale image is representation of image intensity, and the acquisition of the gray-scale image is the prerequisite of image process, hence, in this step, the colorful image needs to be transformed to a gray-scale image.

While performing the transform of gray-scale image, the transform of gray-scale image can be performed with one pixel point as a unit or one pixel block composed of a plurality of pixel points and having a certain size as a unit, such as a pixel block composed of 8×8 pixel points, as required by the actual application.

Step 12, performing filtering of the gray-scale image;

Edge detection algorithm is used to detect the edge based on the first-order or the second-order derivative of the image intensity. Since the calculation of derivative is susceptible to the noise, the filter must be used to improve the performance of edge detection algorithm relative to the noise.

Step 13, performing edge enhancement on the filtered gray-scale image;

The edge enhancement algorithm may highlight the points in an image having significant variation in intensity in adjacent (or local) regions. Generally, the edge enhancement algorithm is accomplished by calculating the variation value in intensity, i.e., a gradient magnitude in adjacent regions of each point in the image.

It is needed to point out that most of the filter reduces the noise along with causing the loss of edge intensity, thus, in actual use, the filtering process of step 12 and the edge enhancement process of step 13 need to be eclectically considered. For instance, if the denoising threshold is set to be a low value in the denoising process, some edge pixel points may be eliminated by mistake, then the extent of edge enhancement should be increased.

Step 14, performing edge points detection on the image on which the edge enhancement has been performed;

In an image, the gradient magnitudes of many points may be relatively large, however, these points are not necessarily the edge points, so the real edge points should be determined.

A gradient magnitude threshold criterion is an common method for detecting the edge points, and this method is well-known in the art and will not be described in details herein.

Step 15, positioning edge positions based on the detected edge points, so as to obtain an edge image of the input image;

in this step, the position of the edge of the input image can be obtained by the detected edge points.

There are many methods for obtaining the position of image edge with edge points in the prior art, which will not be described in detail herein. Furthermore, there is no limitation to the method for obtaining the position of image edge with edge points in the present invention, as long as the method can obtain the position of image edge based on the edge points.

In step 2, detecting whether there is a portion in an edge image, in which the difference of gray level values between one edge pixel point and an adjacent edge pixel point thereof is greater than the predetermined threshold. If not, calculating the weighted average of the gray level values of the pixels in each sub-region of the whole backlight region, so as to obtain the average gray level of the pixels in each pixel sub-region in the whole backlight region, respectively, and then the process is proceeded to step 5; if yes, the edge pixels is considered as sensitive edge pixels. All the sensitive edge pixels in the edge image constitute a sensitive zone, and then the process is proceeded to step 3. Herein, there may be one or more sensitive zones.

A window detection method as a common method in the prior art may be used to detect sensitive edge pixels, the person skilled in this art should understand that when the window detection method is used to detecting the edge pixels, if the detection window is large, the detection speed is high, but the detection accuracy gets low; on the contrary, if the detection window is small, the detection speed is low, the detection accuracy is high. Thus, in actual application, the size of detection window can be selected according to actual requirement for detection.

Furthermore, the weighted average algorithm is the common method for calculating the average gray-scale in this art, which will not be described in details herein.

Step 3, obtaining a smallest backlight region corresponding to each sensitive zone, and calculating a weighted average of the gray level values of the pixels in the smallest backlight region uniformly, so as to obtain a region average gray level of the pixels in the smallest backlight region, that is, obtaining only one region average gray level for the whole smallest backlight region; then performing clipping pre-process on the region average gray level; and on the other hand, calculating a weighted average of gray level values of the pixels in each sub-region of the remaining backlight region, so as to obtain a average gray level of the pixels in each sub-region in the remaining backlight region, respectively;

In an embodiment of the present invention, the clipping pre-process is to increases or decreases the region average gray level by several gray levels, that is to say, if there is a zone in an input image in which the difference between gray levels is quite large and the gray level value of each pixel in the sensitive zone is much lower than the gray level value of each pixel in a zone adjacent to the sensitive zone, the backlight region corresponding to the sensitive zone may be adjusted to be brighter. The degree to increase the gray level value may be set according to the actual requirement. For instance, if the user wants to make the corresponding backlight region brighter, the gray level will be increased much more accordingly, otherwise, much less accordingly. Of course, if there is a sensitive region in which the difference between gray levels is quite large and the gray level value of each pixel in the sensitive zone is much higher than the gray level value of each pixel in the region adjacent to the sensitive zone, the clipping pre-process will become to decrease the region average gray level by several gray levels. The above clipping pre-process may be implemented by a person skilled in this art based on common knowledge, and thus will not be described in details herein. Furthermore, there is no limitation to the specific gray-scale adjusting value of the region average gray level, however, preferably, the value of the average gray level should be increased or decreased by at least two or more gray level, which will alleviate the phenomenon of clipping and edge breakage of image apparently.

Step 4, performing the backlight brightness adjustment with respect to the sensitive zone uniformly based on the region average gray level after the clipping pre-process and performing the backlight brightness adjustment with respect to each sub-region of the remaining backlight region respectively based on the average gray levels of the pixels in the respective sub-regions of the remaining backlight region, and the process ends up.

Step 5, performing the backlight brightness adjustment with respect to the respective sub-regions of the whole backlight region based on the average gray levels of the pixels in the respective sub-regions of the whole backlight region, and the process ends up.

Performing the backlight brightness adjustment based on the average gray level of the pixels in the input image is disclosed in the prior art, which will not be described in details herein.

According to above-mentioned technical solution, since the uniform adjusting is performed in the backlight region corresponding to the sensitive zone, and respective adjusting is performed in the respective sub-regions of other backlight region, the excessive adjusting to the sensitive zone and the inconsistence in adjusting coefficient in the sensitive zone will be avoided, such that the clipping phenomenon due to excessive compensation as well as the phenomenon of edge breakage of image caused by the inconsistent adjusting coefficients in the sensitive zone can both be alleviated, and therefore, the details of original image can be preserved to the full extent.

The above-mentioned specific embodiments further illustrates the objects, technical solutions and advantage effects of the present invention, however, it would be appreciated that the above-mentioned content is only the specific embodiments of the present invention and not intended to limit the present invention, and all the modification, equivalent and improvement made within the spirit and principles of the present invention should be incorporated in the protection scope of the present invention.

What is claimed is:

1. A local backlight brightness adjustment method for a direct backlight in a display device, the method comprising the steps of:

step 1: performing edge detection on an input image to determine whether a sensitive zone exists, the sensitive zone being a portion in the input image in which a gray level difference between adjacent pixels is larger than a predetermined threshold; and step 2: when the sensitive zone exists, performing a backlight brightness adjustment with respect to a backlight region corresponding to the sensitive zone, and performing a backlight brightness adjustment with respect to a remaining backlight region other than the backlight region corresponding to the sensitive zone, respectively;

wherein, in step 2, performing the backlight brightness adjustment with respect to the backlight region corresponding to the sensitive zone comprises:

Step 21: determining a smallest backlight region covering the sensitive zone, the smallest backlight region at least including a plurality of backlight sub-regions corresponding to the sensitive zone;

Step 22: calculating a weighted average of gray level values of the pixels in the smallest backlight region, to obtain a region average gray level of the pixels corresponding to the smallest backlight region; and Step 23: performing the backlight brightness adjustment uniformly with respect to the smallest backlight region based on a calculated region average gray level.

2. The method according to claim 1, wherein, in step 2, performing the backlight brightness adjustment with respect to the remaining backlight region comprises:

calculating a weighted average of gray level values of pixels in each backlight sub-region included in the remaining backlight region, respectively, to obtain an average gray level of each backlight sub-region, respectively;

performing a backlight brightness adjustment with respect to each backlight sub-region based on the average gray level of the pixels in each backlight sub-region, respectively.

3. A local backlight brightness adjustment method for a direct backlight in a display device, the method comprising the steps of:

step 1: performing edge detection on an input image to determine whether a sensitive zone exists, the sensitive zone being a portion in the input image in which a gray level difference between adjacent pixels is larger than a predetermined threshold; and step 2: when the sensitive zone exists, performing a backlight brightness adjustment with respect to a backlight region corresponding to the sensitive zone, and performing a backlight brightness adjustment with respect to a remaining backlight region other than the backlight region corresponding to the sensitive zone, respectively;

wherein, in step 2, performing the backlight brightness adjustment with respect to the backlight region corresponding to the sensitive zone comprises:

Step 21: determining a smallest backlight region covering the sensitive zone, the smallest backlight region at least including a plurality of backlight sub-regions corresponding to the sensitive zone;

Step 22: calculating a weighted average of gray level values of pixels in the determined smallest backlight region, to obtain a region average gray level of the pixels corresponding to the smallest backlight region;

Step 23': performing a clipping pre-process on the region average gray level, and performing a backlight brightness adjustment uniformly with respect to the smallest backlight region based on the region average gray level obtained after the clipping pre-process, wherein the clipping pre-process comprises increasing or decreasing the region average grey level.

4. The method according to claim 3, wherein, in step 2, performing the backlight brightness adjustment with respect to the remaining backlight region comprises:

calculating a weighted average of gray level values of pixels in each backlight sub-region included in the remaining backlight region, to obtain an average gray level of each backlight sub-region in the remaining backlight region, respectively;

performing a backlight brightness adjustment with respect to each backlight sub-region, based on the average gray level of the pixels in each backlight sub-region in the remaining backlight region, respectively.

5. The method according to claim 3, wherein, if the region average gray level of the pixels corresponding to the smallest backlight region is lower than an average gray level of pixels in a region adjacent to the smallest backlight region, the clipping pre-process comprises increasing the region average gray level; the region average gray level of the pixels corresponding to the smallest backlight region is higher than an average gray level of pixels in a region adjacent to the smallest backlight region, the clipping pre-process comprises decreasing the region average gray level of the pixels corresponding to the smallest backlight region.

6. A local backlight brightness adjustment method for a direct backlight in a display device, the method comprising the steps of:

step 1: performing edge detection on an input image to determine whether a sensitive zone exists, the sensitive zone being a portion in the input image in which a gray level difference between adjacent pixels is larger than a predetermined threshold; and step 2: when the sensitive zone exists, performing a backlight brightness adjustment with respect to a backlight region corresponding to the sensitive zone, and performing a backlight brightness adjustment with respect to a remaining backlight region other than the backlight region corresponding to the sensitive zone, respectively;

wherein, in step 1, the edge detection comprises the following steps:

Step 11: obtaining a gray-scale image based on an input image signal; Step 12: performing filtering of the gray-scale image;

Step 13: performing edge enhancement on the filtered gray-scale image; Step 14: performing edge point detection on the image on which the edge enhancement has been performed Step 15: positioning edge positions based on detected edge points, so as to obtain an edge image of an input image;

Step 16: detecting whether there is a portion in the edge image, in which a gray level difference between one pixel and an adjacent pixel thereof is greater than the predetermined threshold, and defining the portion as the sensitive zone.

7. The method according to claim 6, wherein, in step 11, performing a gray-scale image transform by taking a pixel point or a pixel block as a unit.

8. The method according to claim 6, wherein, in step 13, performing the edge enhancement by calculating an intensity variation in adjacent regions of each point in the image.

9. The method according to claim 6, wherein, in step 14, performing the edge point detection by using a gradient magnitude threshold criterion.

10. The method according to claim 6, characterized in that, in step 15, the position of the edge of the input image is obtained with the detected edge points.

* * * * *